United States Patent [19]

Newman

[11] Patent Number: 4,770,136

[45] Date of Patent: Sep. 13, 1988

[54] KEROSENE ENGINE WITH KEROSENE START

[75] Inventor: Neil A. Newman, Omro, Wis.

[73] Assignee: Brunswick Corporation, Skokie, Ill.

[21] Appl. No.: 96,921

[22] Filed: Sep. 14, 1987

[51] Int. Cl.[4] ..... F02N 17/08; F02N 17/04

[52] U.S. Cl. ..... 123/179 A; 123/48 A; 123/73 A; 123/179 H; 123/549

[58] Field of Search ..... 123/179 A, 179 C, 179 H, 123/182, 48 A, 48 AA, 48 R, 73 A, 549, 179 R

[56] References Cited

U.S. PATENT DOCUMENTS

| | | | |
|---|---|---|---|
| 1,680,710 | 8/1928 | Wall | 123/48 A |
| 4,328,771 | 5/1982 | Kawai et al. | 123/179 BG |
| 4,543,921 | 10/1985 | Torigai et al. | 123/73 A |

FOREIGN PATENT DOCUMENTS

| | | | |
|---|---|---|---|
| 2519159 | 11/1976 | Fed. Rep. of Germany | 123/48 A |
| 334312 | 3/1921 | Fed. Rep. of Germany | 123/48 A |
| 2259998 | 8/1975 | France | 123/179 H |
| 612224 | 11/1948 | United Kingdom | 123/48 A |

*Primary Examiner*—Andrew M. Dolinar

*Attorney, Agent, or Firm*—Andrus, Sceales, Starke & Sawall

[57] ABSTRACT

In a two cycle kerosene fueled internal combustion engine, the temperature of the kerosene-air mixture is raised sufficiently to enable starting by spark ignition, without the assist of gasoline. The combustion chamber (16) is temporarily contracted by a moveable cylinder head (40) during starting to temporarily increase the compression ratio and increase the temperature of the kerosene-air mixture by increased compression pressure. The exhaust port (30) is closed by an obstruction valve (88) during starting to trap the mixture in the combustion chamber (16) such that each compression charging stroke of the piston (4) adds further heat of compression to the mixture to further heat same. An electrical resistance heater wire (114) is provided in the kerosene-air transfer passage (24) between the crankcase (14) and the inlet port (26) to the combustion chamber (16) to further heat the mixture to facilitate ignition. A compression relief valve (98) is provided for each of the remaining cylinders (34) such that cranking of the engine during starting must overcome the increased compression pressure in the contracted combustion chamber (16) but not the other combustion chambers (36).

20 Claims, 4 Drawing Sheets

FIG. 2
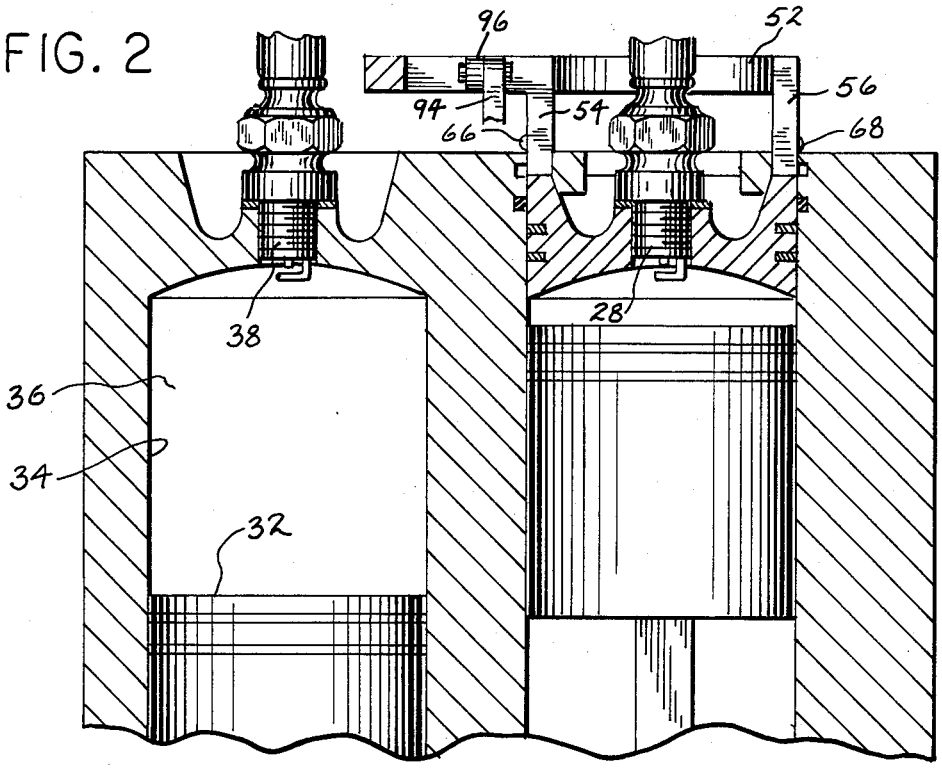
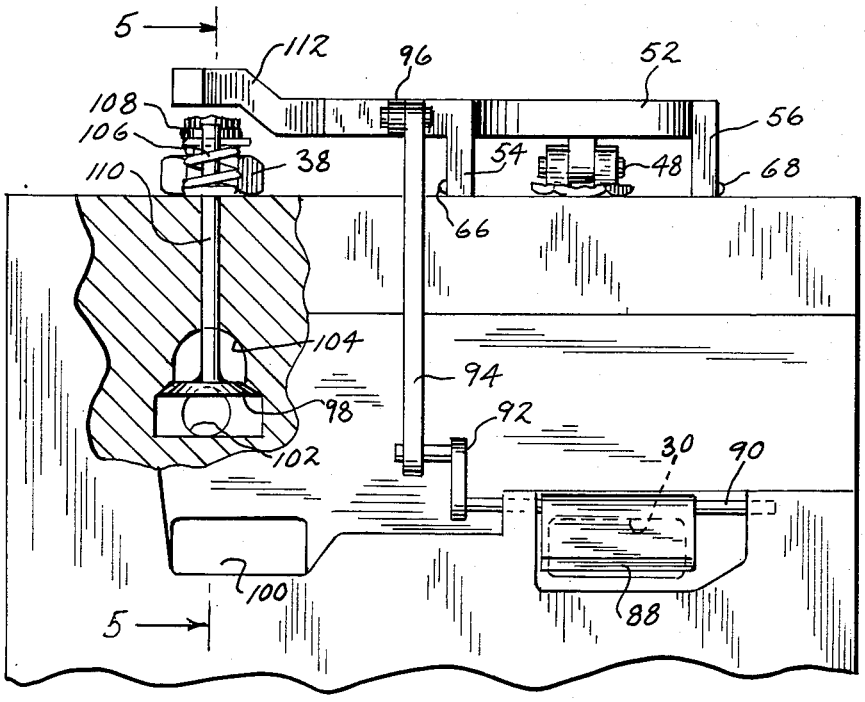
FIG. 3

KEROSENE ENGINE WITH KEROSENE START

BACKGROUND

The invention relates to internal combustion engines run on kerosene fuel. The invention particularly arose during development efforts to provide a two cycle internal combustion engine which can be started solely with kerosene, without the assist of gasoline.

Kerosene and similar fuels have higher distillation temperatures than gasoline. In the prior art, a kerosene engine is started with gasoline. After starting, the gasoline is mixed in variable quantities with kerosene to facilitate smooth operation until the engine reaches sufficient operating temperature that the kerosene alone will vaporize and can be ignited by the spark plug. In a diesel engine, the fuel-air mixture temperature is raised so high by the extraordinarily high compression ratio that it is ignited without a spark plug. In a kerosene engine, the fuel-air mixture temperature required for spark plug ignition is substantially less than that for diesel ignition.

In many areas of the world kerosene fuel is preferred because it is cheaper, or in many cases is the only fuel available. It is therefore desirable to provide an engine which can be operated solely on kerosene, totally excluding the use of gasoline. Diesel ignition is not desirable because of the significantly increased cost of the components necessary to withstand the higher compression ratios. A spark ignition type engine is less costly, due to its lower compression ratios and lower stress on components.

The primary problem in totally excluding the use of gasoline in a spark ignition kerosene engine is the problem of starting the engine.

SUMMARY

The present invention provides a spark ignition kerosene engine which not only runs but also starts on kerosene, without the assist of gasoline. The invention addresses and solves the above noted starting problem in a particularly simple and efficient manner.

The temperature of the kerosene-air mixture is raised sufficiently to enable ignition by the spark plug. The combustion chamber is contracted during starting to temporarily increase the compression ratio and hence increase the temperature of the kerosene-air mixture by increased compression pressure. The exhaust port is closed during starting to trap the mixture in the combustion chamber such that each compression charging stroke of the piston adds further heat of compression to the mixture to yet further heat same. Compression relief valves are provided for the remaining cylinders such that cranking of the engine during starting must overcome the increased compression pressure in the contracted combustion chamber but not the other combustion chambers.

In the preferred embodiment, a simple single handle actuates each of the contracting, exhaust-blocking and compression-relieving components to their starting positions, and is automatically returned to a running condition opening the exhaust and closing the compression relief in response to expansion of the one combustion chamber.

BRIEF DESCRIPTION OF THE DRAWINGS

FIG. 2 is a sectional view taken along line 2—2 of FIG. 1.

FIG. 3 is a side view of a portion of the structure in FIG. 1.

DETAILED DESCRIPTION

Figure 1:
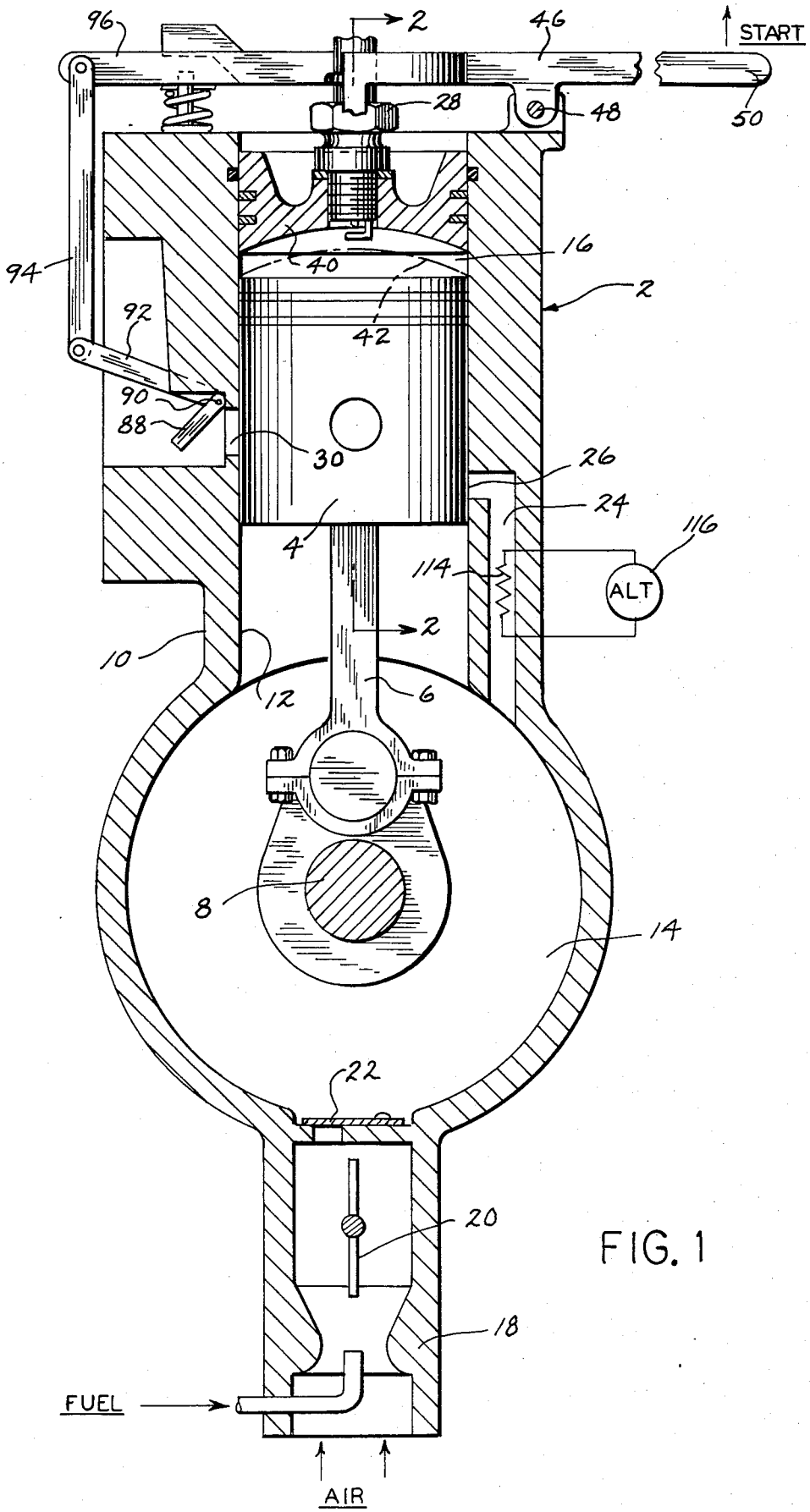
FIG. 1 is a sectional view of a two cycle internal combustion kerosene engine in accordance with the invention.

FIG. 1 shows a two cycle internal combustion engine 2 having a piston 4 connected by connecting rod 6 to crankshaft 8 in cylinder block 10. Piston 4 is axially reciprocal in cylinder 12 between crankcase 14 and combustion chamber 16. Kerosene and air are supplied through carburetor 18, throttle control valve 20 and one-way reed valve 22 to crankcase 14. A kerosene-air transfer passage 24 extends between crankcase 14 and a kerosene-air inlet port 26 in the combustion chamber. A spark plug 28 in the combustion chamber ignites the kerosene-air mixture. An exhaust port 30 in the combustion chamber exhausts the products of combustion of the kerosene-air mixture.

As is standard in the art, piston 4 has a charging stroke in the upward direction compressing fuel-air mixture in combustion chamber 16 and creating a vacuum in crankcase 14. During this upward stroke, kerosene-air mixture is drawn through one-way reed valve 22 into crankcase 14. Also during the upward stroke, piston 4 closes inlet 26 and outlet 30, thus trapping the mixture in combustion chamber 16 and compressing same. Upon ignition by spark plug 28, combustion of the mixture in chamber 16 drives the piston downwardly providing the latter's power stroke. Downward movement of piston 4 pressurizes crankcase 14 and forces kerosene-air mixture to flow from crankcase 14 through transfer passage 24 to inlet port 26 for repetition of the cycle. The spent combustion products are exhausted through exhaust port 30 as opened when piston 4 travels downwardly therepast. The structure and operation described thus far is standard and known in the prior art.

In multi cylinder engines, the engine block includes other pistons such as 32, FIG. 2, each axially reciprocal in its respective cylinder 34 between its respective section of the crankcase and its respective combustion chamber 36, and including its own respective spark plug 38. Each cylinder includes its own fuel-air inlet port and transfer passage from its respective crankcase section, and its own exhaust port. Each cylinder and crankcase section may have its own carburetor, or one or more carburetors may supply multiple cylinders. Alternatively, the fuel supply can be provided by fuel injection. The exhaust ports may be exhausted individually or combined in a common manifold. The multi cylinder engine described thus far is standard and also known in the art.

Figure 6:
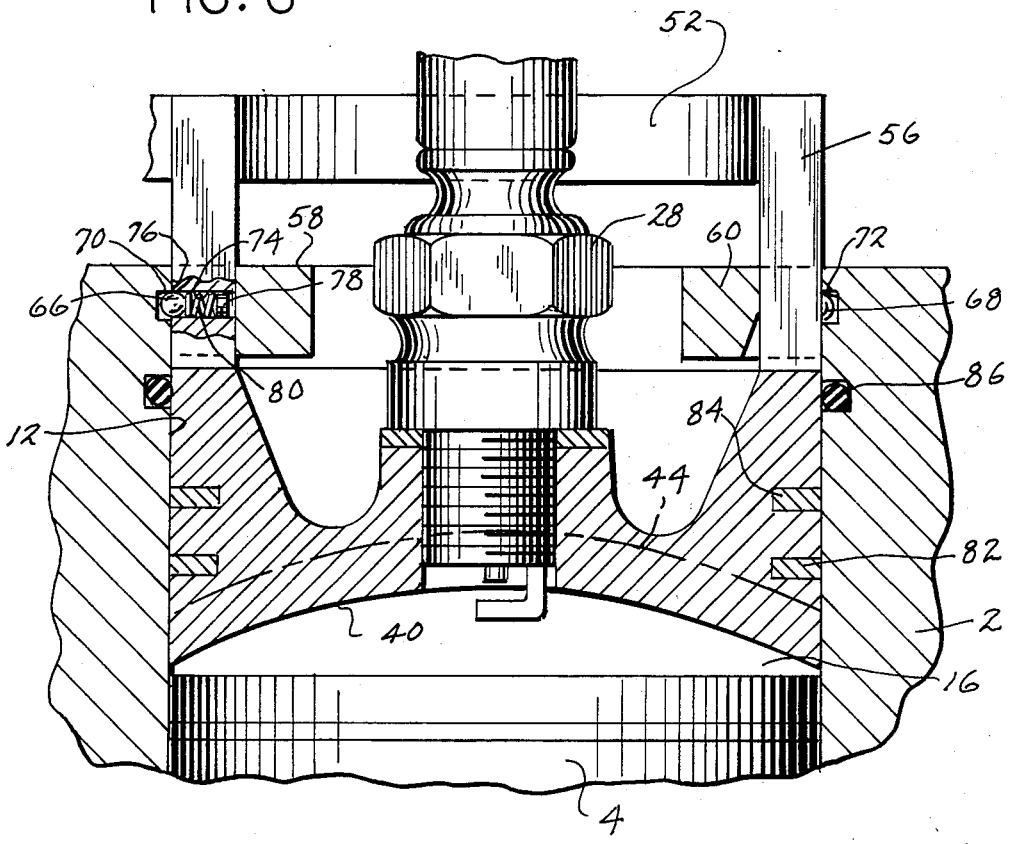
FIG. 6 is an enlarged view of a portion of the structure of FIG. 1.

In the present invention, a moveable plug is provided by a moveable cylinder head 40 axially reciprocal in cylinder 12 between a first lower position as shown at dashed line 42 in FIG. 1, and a second upper position as shown in solid line in FIG. 1. FIG. 6 shows moveable cylinder head 40 in the lower position in solid line, and in the upper position at dashed line 44. In the lower position, moveable cylinder head 40 contracts combustion chamber 16 to increase the compression ratio in the combustion chamber to in turn increase the temperature of the kerosene-air mixture to facilitate ignition by spark plug 28. In the upper position, moveable cylinder head 40 expands combustion chamber 16 to decrease the compression ratio to one suitable for kerosene operation after starting and during normal running. As seen in FIGS. 1 and 6, movement of cylinder head 40 to the lower position 42 decreases the clearance volume to piston 4. Movement of cylinder head 40 to the upper position 44 increases the clearance volume to piston 4. In one embodiment, the increased compression ratio for starting is about 18:1, and the decreased compression ratio for running is about 8:1.

Figure 4:
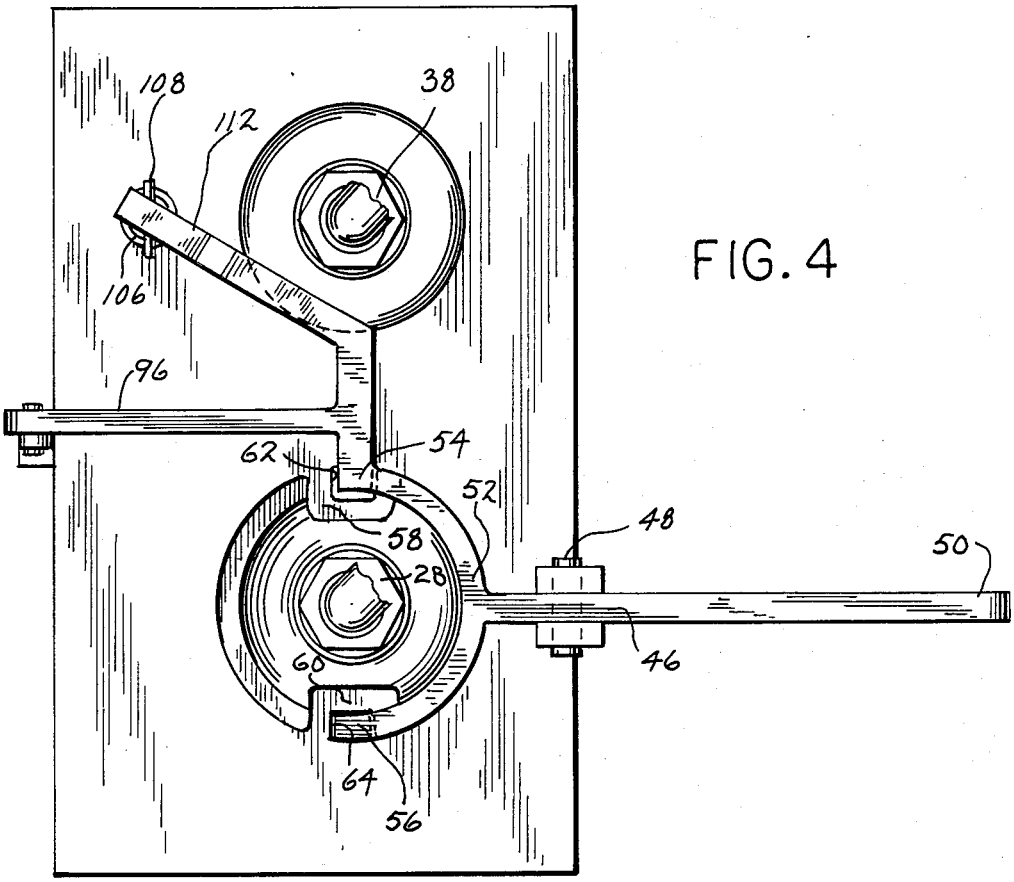
FIG. 4 is a top view of the structure in FIG. 1.
Figure 7:
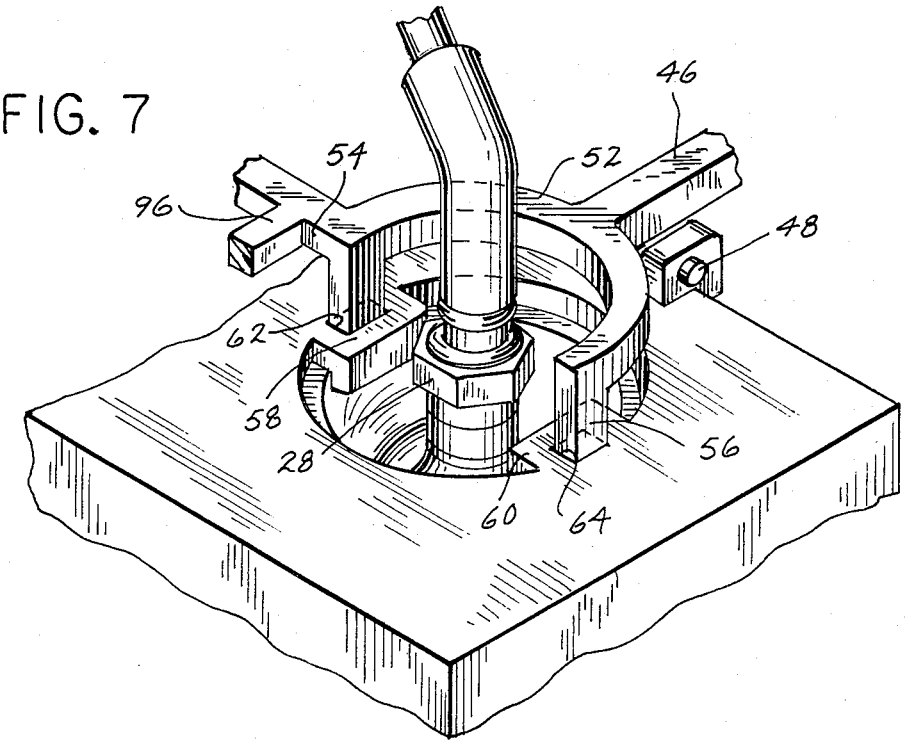
FIG. 7 is a perspective view of a portion of the structure of FIG. 4.

A starting lever or handle 46 is pivotally mounted to the engine at pivot pin 48. In FIG. 1, the right end 50 of the handle is engaged by the hand of the user and pulled upwardly, which pivots lever 46 counterclockwise about pin 48 such that the left end 52 of the handle moves downwardly. The left end of the handle is semicircular, FIGS. 4 and 7, having a diameter about the same as that of cylinder 12 therebelow. At the ends of semicircle 52, a pair of legs 54 and 56 extend downwardly to engage moveable cylinder head 40. The engine block includes a pair of tabs 58 and 60 extending radially inwardly towards each other from the perimeter of cylinder 12. Each tab has a respective hole 62 and 64 therethrough through which respective legs 54 and 56 extend to engage moveable cylinder head 40 therebelow. Tabs 58 and 60 provide a stop to limit upward movement of cylinder head 40.

When handle 46 is pivoted counterclockwise, FIG. 1, handle legs 54 and 56 push moveable cylinder head 40 downwardly to the downward position shown in FIG. 6. A pair of spring biased balls 66 and 68 coact with respective recesses 70 and 72 in the wall of cylinder 12 to releasably hold handle legs 54 and 56 and cylinder head 40 in the downward position during starting of the engine. Ball 66 is carried in a transverse aperture 74 through leg 54 having a slightly inwardly crimped left outer lip 76 to retain the ball therein, and having a plug 78 screwed thereinto from the right to hold biasing spring 80 against ball 66. Ball 66 is biased into recess 70 in the cylinder wall, which recess may be an annular groove which also provides recess 72. The detent provided by ball 68 is comparable. The mechanical force applied by detent balls 66 and 68 is sufficient to withstand compression pressure in combustion chamber 16 during starting, but insufficient to withstand combustion pressure in combustion chamber 16 upon ignition of the kerosene-air mixture by spark plug 28. The detents hold moveable head 40 in its downward position during starting, but release the cylinder head to move upwardly to its upper position stopped against tabs 58 and 60 after starting and during running of the engine upon ignition of the kerosene-air mixture by spark plug 28. Rings 82 and 84 around head 40 engage the wall of cylinder 12 and seal the escape of combustion gases therepast. O-ring 86 in the wall of cylinder 12 engages moveable head 40 and provides additional sealing.

Upward movement of cylinder head 40 moves handle legs 54 and 56 upwardly which in turn pivots handle 46 clockwise and moves the operator engaged portion 50 of the handle downwardly, FIG. 1, to a running position. The handle is automatically returned to the running position without manual intervention by the operator.

An obstruction valve 88 is in exhaust port 30 and is moveable between an open position during running of the engine permitting passage through exhaust port 30, and a closed position during starting of the engine to block such passage and prevent escape of the compressed mixture from combustion chamber 16. Valve 88 is a plate hinged at pivot pin 90, and connected by links 92 and 94 to a left extension arm 96 of handle 46. When handle 46 is pivoted counterclockwise about pivot 48 to the starting position, left extension arm 96 moves downwardly, FIG. 1, to close valve 88. The kerosene-air mixture in combustion chamber 16 is further heated by the compression pressure during each compression charging stroke of piston 4 due to the mixture being trapped in combustion chamber 16 by closed valve 88. This further heating by compression pressure during each charging stroke of the piston further facilitates ignition of the mixture by spark plug 28. The temperature of the kerosene-air mixture is raised by the temporarily increased compression ratio and by the repetitive compression pressure applied to the mixture during each charging stroke of the piston. Upon ignition, cylinder head 40 moves upwardly, as above described, to pivot handle 46 clockwise about pivot 48, which in turn moves left arm extension 96 upwardly thus opening valve 88 to permit the spent combustion products to be exhausted through exhaust port 30. The automatic return of handle 46 to the running position also automatically opens obstruction valve 88.

Figure 5:
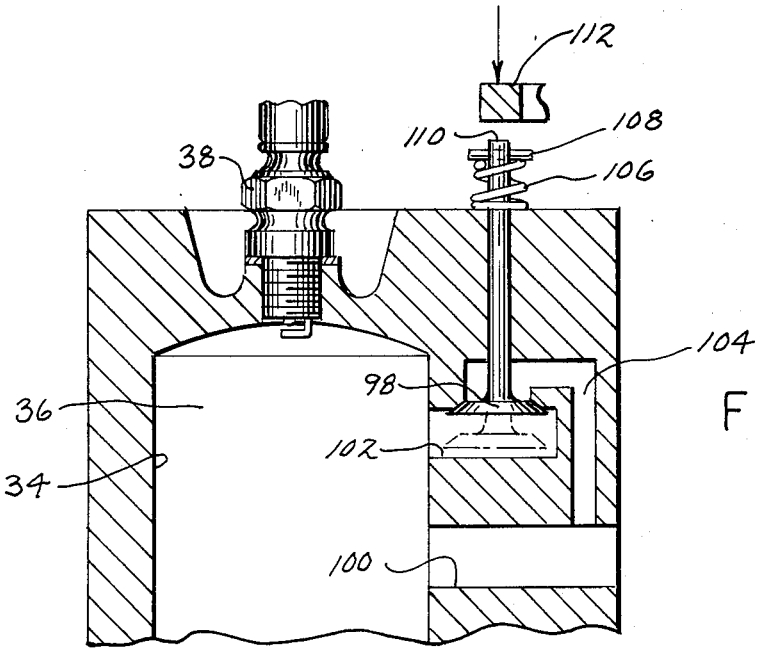
FIG. 5 is a sectional view taken along line 5—5 of FIG. 3.

Each of the remaining cylinders such as cylinder 34, FIG. 2, has a compression relief valve 98, FIG. 5, actuated during starting of the engine to relieve compression pressure during the charging stroke of piston 32. Cranking of the engine during starting must overcome the increased compression pressure in contracted combustion chamber 16 of cylinder 12 but not combustion chamber 36 of cylinder 34.

The products of combustion from combustion chamber 36 are exhausted through exhaust port 100, FIG. 5. Valve 98 is in a second exhaust port 102 above port 100 and connected to the latter through passage 104 which is opened and closed by valve 98. Exhaust port 100 is opened and closed by piston 32 sliding downwardly and upwardly therepast, respectively. Upper exhaust port 102 remains unclosed by piston 32 during its upward charging stroke. During running of the engine, valve 98 is in its upward closed position, as shown at solid line in FIG. 5. During starting of the engine, valve 98 is in its downward open position, as shown at dashed line in FIG. 5, such that the compression pressure in combustion chamber 36 is relieved through upper exhaust port 102, open valve 98 and passage 104.

Valve 98 is normally closed by compression spring 106 bearing between the engine and a pin 108 extending transversely through an aperture in the stem 110 of valve 98. The upper end of valve stem 110 is engaged by another left arm extension 112 of handle 46. When handle 46 is pivoted counterclockwise to the its starting position, left arm extension 112 moves downwardly to engage valve stem 110 and move valve 98 downwardly to its open position shown in dashed line in FIG. 5. This provides the above noted compression relief such that during cranking the operator need not overcome the compression in the remaining cylinders, and need only crank against the increased compression in cylinder 12. Upon ignition, moveable cylinder head 40 moves upwardly, as above described, causing handle 46 to pivot clockwise about pivot 48 which in turn moves left arm extension 112 upwardly which allows valve 98 to close. This in turn enables compression to be developed in combustion chamber 36 of cylinder 34.

In a further embodiment, additional heating of the kerosene-air mixture is provided by resistance heater wire 114 in transfer passage 24 having electrical current supplied thereto by the engine alternator 116. This additional heating of the kerosene-air mixture further raises the temperature of the latter to facilitate ignition.

In order to ensure that during starting a kerosene-air mixture for combustion is trapped within the cylinder, the preferred starting procedure is as follows. The engine is initially cranked with handle 46 in its clockwise-pivoted running position to generate a flow of kerosene-air mixture through the engine including into combustion chamber 16. Handle 46 is then pivoted counter-clockwise to its starting position, and the engine is cranked until it starts. Alternatively, a priming mechanism could be used to initially inject kerosene into the combustion chamber.

It is recognized that various equivalents, alternatives and modifications are possible within the scope of the appended claims.

I claim:

1. A kerosene start and kerosene run internal combustion engine comprising:

a piston reciprocal in a cylinder between a crankcase and a combustion chamber;

fuel supply means supplying a kerosene-air mixture to said combustion chamber;

a spark plug in said combustion chamber to ignite said kerosene-air mixture;

exhaust means exhausting the products of combustion from said combustion chamber;

means contracting said combustion chamber during starting of said engine to increase the compression ratio in said combustion chamber to in turn increase the temperature of said kerosene-air mixture to facilitate ignition by said spark plug, and expanding said combustion chamber after starting and during running of said engine to decrease the compression ratio in said combustion chamber, said last mentioned means comprising moveable plug means in said cylinder moveable to a first position decreasing the clearance volume to said piston, and moveable to a second position increasing the clearance volume to said piston;

actuator means moveable to a starting condition moving said plug means to said first position, and wherein said actuator means is automatically returned to a running condition in response to said plug means moving to said second position.

2. A kerosene start and kerosene run internal combustion engine comprising:

a piston reciprocal in a cylinder between a crankcase and a combustion chamber;

fuel supply means supplying a kerosene-air mixture to said combustion chamber;

a spark plug in said combustion chamber to ignite said kerosene-air mixture;

exhaust means exhausting the products of combustion from said combustion chamber;

means contracting said combustion chamber during starting of said engine to increase the compression ratio in said combustion chamber to in turn increase the temperature of said kerosene-air mixture to facilitate ignition by said spark plug, and expanding said combustion chamber after starting and during running of said engine to decrease the compression ratio in said combustion chamber, wherein said last mentioned means comprises moveable plug means in said cylinder moveable to a first position decreasing the clearance volume to said piston, and moveable to a second position increasing the clearance volume to said piston;

actuator means actuated by the operator to a starting condition moving said plug means to said first position, and wherein said actuator means is automatically returned to a running condition in response to said plug means moving to said second position.

3. A kerosene start and kerosene run internal combustion engine comprising:

a piston reciprocal in a cylinder between a crankcase and a combustion chamber;

fuel supply means supplying a kerosene-air mixture to said combustion chamber;

a spark plug in said combustion chamber to ignite said kerosene-air mixture;

exhaust means exhausting the products of combustion from said combustion chamber;

means contracting said combustion chamber during starting of said engine to increase the compression ratio in said combustion chamber to in turn increase the temperature of said kerosene-air mixture to facilitate ignition by said spark plug, and expanding said combustion chamber after starting and during running of said engine to decrease the compression ratio in said combustion chamber, wherein said last mentioned means comprises moveable plug means in said cylinder moveable to a first position decreasing the clearance volume to said piston, and moveable to a second position increasing the clearance volume to said piston;

obstruction means in said exhaust means and closed during starting of the engine to prevent escape of said kerosene-air mixture from said combustion chamber such that said mixture is repeatedly compressed by said piston, which increases the heat of said mixture to facilitate ignition by said spark plug, and means for opening said obstruction means after starting and during running of said engine to permit exhausting of the products of combustion from said combustion chamber;

actuator means actuated by the operator to a starting condition moving said plug means to said first position and also closing said obstruction means, and wherein said actuator means is automatically returned to a running condition and opens said obstruction means in response to said plug means moving to said second position.

4. A kerosene start and kerosene run two cycle internal combustion engine comprising:

a piston axially reciprocal in a cylinder between a crankcase and a combustion chamber;

means for supplying kerosene and air to said crankcase;

kerosene-air inlet port means in said combustion chamber;

kerosene-air transfer passage means between said crankcase and said kerosene-air inlet port means in said combustion chamber;

a spark plug in said combustion chamber for igniting said kerosene-air mixture;

exhaust port means in said combustion chamber exhausting the products of combustion;

said piston having a charging stroke in one axial direction compressing the kerosene-air mixture in said combustion chamber and creating a vacuum in said crankcase and having a power stroke upon combustion of said mixture driving said piston in the opposite axial direction pressurizing said crankcase and forcing kerosene-air mixture to flow from said crankcase through said transfer passage means to said kerosene-air inlet port means in said combustion chamber for repetition of the cycle, the spent combustion products being exhausted through said exhaust port means;

a moveable cylinder head axially reciprocal in said cylinder between first and second positions, said cylinder head being moveable toward said piston to said first position to contract said combustion chamber during starting of said engine to increase the compression ratio in said combustion chamber to in turn increase the temperature of said kerosene-air mixture to facilitate ignition by said spark plug, said cylinder head being moveable away from said piston to said second position expanding said combustion chamber after starting and during running of said engine to decrease the compression ratio in said combustion chamber, wherein said spark plug is mounted to said moveable cylinder head and reciprocates axially therewith;

detent means releasably holding said cylinder head in said first position during starting of said engine, said detent means releasing said cylinder head to move to said second position after starting and during running of said engine upon ignition of said kerosene-air mixture by said spark plug, said detent means applying a mechanical force sufficient to withstand compression pressure in said combustion chamber during said starting, and insufficient to withstand combustion pressure in said combustion chamber upon ignition of said kerosene-air mixture.

5. The invention according to claim 4 comprising a handle mounted to said engine and actuated by the operator and engaging and moving said cylinder head toward said piston to said first position, and comprising stop means fixed to said engine and limiting movement of said cylinder head away from said piston to halt said cylinder head at said second position.

6. The invention according to claim 5 wherein said handle has a starting position and a running position, wherein movement of said handle to said starting position moves said cylinder head to said first position, and wherein said handle is moved by said cylinder head to said running position of said when said cylinder head moves to said second position.

7. The invention according to claim 6 wherein said detent means coacts with said handle to hold the latter in said starting position which in turn holds said cylinder head in said first position until ignition of said kerosene-air mixture by said spark plug which drives said cylinder head to said second position which drives said handle to said running position overcoming said detent means.

8. The invention according to claim 7 wherein said detent means comprises a spring biased ball between said handle and a wall of said cylinder in said starting position.

9. The invention according to claim 8 wherein said handle extends into said cylinder, and wherein said spring biased ball is carried on said handle and engages a recess in said cylinder wall in said starting position.

10. A kerosene start and kerosene run two cycle internal combustion engine comprising:

a piston axially reciprocal in a cylinder between a crankcase and a combustion chamber;

means for supplying kerosene and air to said crankcase;

kerosene-air inlet port means in said combustion chamber;

kerosene-air transfer passage means between said crankcase and said kerosene-air inlet port means in said combustion chamber;

a spark plug in said combustion chamber to ignite said kerosene-air mixture;

exhaust port means in said combustion chamber for exhausting the products of combustion of said kerosene-air mixture;

said piston having a charging stroke in one axial direction compressing said kerosene-air mixture in said combustion chamber and creating a vacuum in said crankcase, and having a power stroke upon combustion of said mixture driving said piston in the opposite axial direction pressurizing said crankcase and forcing kerosene-air mixture to flow from said crankcase through said transfer passage means to said kerosene-air inlet port means in said combustion chamber for repetiton of the cycle, the spent combustion products being exhausted through said exhaust port means;

obstruction valve means in said exhaust port means moveable between a closed position during starting of said engine to block passage through said exhaust port means and prevent escape of said compressed mixture from said combustion chamber, and an open position permitting passage through said exhaust port means;

means contracting said combustion chamber during starting of said engine to increase the compression ratio in said combustion chamber to in turn increase the temperature of said kerosene-air mixture to facilitate ignition by said spark plug, said mixture being further heated during each compression charging stroke of said piston during starting due to said mixture being trapped in said combustion chamber by said closed obstruction valve means in said exhaust port means, said moveable plug means expanding said combustion chamber after starting and during running of said engine to decrease the compression ratio in said combustion chamber.

11. The invention according to claim 10 comprising a handle mounted to said engine and actuated by the operator to a starting position engaging and moving said plug means to contract said combustion chamber and also engaging and closing said obstruction valve means, and wherein movement of said plug means to expand said combustion chamber moves said handle to a running position which in turn moves said obstruction valve means to said open position.

12. The invention according to claim 11 wherein said handle is pivotally mounted to said engine and includes a first arm engaging said moveable plug means and a second arm engaging said obstruction valve means, such that a single handle operates both said moveable plug means and said obstruction valve means.

13. The invention according to claim 10 comprising electrical heater wire means in said kerosene-air transfer passage means for heating said kerosene-air mixture such that the temperature of the latter is raised by said higher compression ratio in said combustion chamber due to contraction of the latter during starting and is also raised by repeated compression during charging strokes of said piston due to said closed obstruction valve means and is also raised by said electrical heater wire means in said transfer passage means.

14. A kerosene start and kerosene run two cycle internal combustion engine comprising:

a plurality of pistons each axially reciprocal in a respective cylinder between a respective section of a crankcase and a respective combustion chamber;

means for supplying kerosene and air to said crankcase sections;

kerosene-air inlet port means in each respective said combustion chamber;

kerosene-air transfer passage means between each respective said crankcase section and each respective said kerosene-air inlet port means in said respective combustion chamber;

a plurality of spark plugs each in a respective said combustion chamber to ignite said kerosene-air mixture;

exhaust port means in each respective combustion chamber for exhausting the products of combustion of said kerosene-air mixture from the respective said combustion chamber;

each said piston having a charging stroke in one axial direction compressing said kerosene-air mixture in its respective said combustion chamber and creating a vacuum in its respective said crankcase section, and having a power stroke upon combustion of said mixture driving said piston in the opposite axial direction pressurizing said respective crankcase section and forcing kerosene-air mixture to flow from said respective crankcase section through said respective transfer passage means to said respective kerosene-air inlet port means in said respective combustion chamber for repetition of the cycle, the spent combustion products being exhausted through the respective said exhaust port means;

one of said cylinders having plug means for contracting its respective said combustion chamber during starting of said engine to increase the compression ratio in said respective combustion chamber to in turn increase the temperature of said kerosene-air mixture to facilitate ignition by said spark plug, and expanding said respective combustion chamber after starting and during running of said engine to decrease the compression ratio in said respective combustion chamber;

the remaining of said cylinders having compression relief means actuated during starting of said engine to relieve the compression pressure during said charging stroke of the respective said piston such that cranking of said engine during starting must overcome the increased compression pressure in said cylinder with said contracted combustion chamber but not the combustion chambers of the remaining of said cylinders.

15. The invention according to claim 14 comprising a handle mounted to said engine and actuated by the operator to a starting position engaging and moving said plug means to contract said respective combustion chamber and also actuating said compression relief means of the remaining of said cylinders, and wherein said handle is moved by said plug means to a running position by said plug means moving to expand said respective combustion chamber, which handle movement to said running position deactuates said compression relief means in the remaining of said cylinders to enable compression pressure in the remaining said combustion chambers during the charging stroke of the respective said pistons, such that a single handle actuates said plug means and said compression relief means and such that movement of said plug means to expand said respective combustion chamber automatically deactuates said compression relief means through said handle means.

16. The invention according to claim 14 wherein said exhaust port means is closed by said piston during said charging stroke, and wherein said compression relief means comprises second exhaust port means in said combustion chamber of said remaining cylinders spaced from said first mentioned exhaust port means and remaining unclosed by the respective said piston during said charging stroke, and a compression relief valve in each of said second exhaust port means closing the latter during running of said engine and being open during starting of said engine, such that during starting of said engine compression pressure in the combustion chambers of said remaining cylinders is relieved through said second exhaust port means and said open compression relief valve.

17. The invention according to claim 16 wherein said second exhaust port means includes passage means connected to said first mentioned exhaust port means, and wherein said compression relief valve closes and opens said last mentioned passage means.

18. A kerosene start and kerosene run two cycle internal combustion engine comprising:

a plurality of pistons reciprocal in a plurality of respective cylinders between respective sections of a crankcase and respective combustion chambers;

means for supplying kerosene and air to said crankcase sections;

kerosene-air inlet port means in each of said combustion chambers;

kerosene-air transfer passage means between each respective said crankcase section and each respective said kerosene-air inlet port means in respective said combustion chambers;

a plurality of spark plugs each in a said respective combustion chamber for igniting said kerosene-air mixture;

exhaust port means in each respective said combustion chamber for exhausting the products of combustion of said kerosene-air mixture from said respective combustion chamber;

moveable plug means contracting the combustion chamber of one of said cylinders during starting of said engine to increase the compression ratio of said one combustion chamber to in turn increase the temperature of said kerosene-air mixture to facilitate ignition by said respective spark plug, and expanding said one combustion chamber after starting and during running of said engine to decrease the compression ratio in said one combustion chamber;

obstruction valve means in said exhaust port means of said one combustion chamber having a closed position during starting of said engine to prevent escape of said kerosene-air mixture from said one combustion chamber such that said trapped mixture in said one combustion chamber is further heated by compression pressure during each charging stroke of said respective piston, to further facilitate ignition of said mixture by said respective spark plug, said obstruction valve means having an open position during running of said engine to permit spent combustion products to be exhausted through said respective exhaust port means;

compression relief valve means in the combustion chambers of the remaining of said cylinders and having an open position during starting of said engine to relieve compression pressure in said remaining combustion chambers such that cranking of said engine during starting must overcome the increased compression pressure in said one combustion chamber but not the remaining combustion chambers, said compression relief valve means having a closed position during running of said engine such that compression pressure is developed in said remaining combustion chambers during running of said engine.

19. The invention according to claim 18 comprising a handle mounted to said engine and actuated by the operator to a starting position engaging and moving said moveable plug to contract said one combustion chamber and also engaging and moving said obstruction valve to said closed position and also engaging and moving said compression relief valve means to said open position, such that a single handle actuates said plug means, said obstruction valve means and said compression relief valve means.

20. The invention according to claim 19 wherein said handle is moved to a running position by movement of said plug means to expand said one combustion chamber, movement of said handle to said running position moving said obstruction valve means to said open position and also moving said compression relief valve means to said closed position.

* * * * *